US007017256B2

(12) United States Patent
Joly et al.

(10) Patent No.: US 7,017,256 B2
(45) Date of Patent: Mar. 28, 2006

(54) METHOD FOR PRODUCING A JACKETED MOBILE ANTENNA

(75) Inventors: Christian Joly, St. Denis (FR); Tobias Kleinert, Reutlingen (DE)

(73) Assignee: Hirshmann Electronics GmbH & Co. KG, Neckartenzlingen (DE)

( * ) Notice: Subject to any disclaimer, the term of this patent is extended or adjusted under 35 U.S.C. 154(b) by 0 days.

(21) Appl. No.: 10/310,958

(22) Filed: Dec. 6, 2002

(65) Prior Publication Data

US 2003/0145452 A1 Aug. 7, 2003

(30) Foreign Application Priority Data

Dec. 7, 2001 (DE) ..... 101 60 253

(51) Int. Cl.
*H01P 11/00* (2006.01)

(52) U.S. Cl. ..... 29/600; 29/601; 29/858; 343/895

(58) Field of Classification Search ..... 343/906, 343/873, 895; 29/848, 600, 602.1, 605, 606; 336/192, 208; 340/572.8
See application file for complete search history.

(56) References Cited

U.S. PATENT DOCUMENTS

| | | | | |
|---|---|---|---|---|
| 3,774,221 | A * | 11/1973 | Francis | 343/749 |
| 4,435,713 | A * | 3/1984 | Gasparaitis et al. | 343/702 |
| 4,725,395 | A * | 2/1988 | Gasparaitis et al. | 264/250 |
| 5,341,149 | A * | 8/1994 | Valimaa et al. | 343/895 |
| 5,742,259 | A * | 4/1998 | Annamaa | 343/895 |
| 6,137,452 | A * | 10/2000 | Sullivan | 343/873 |
| 6,147,660 | A * | 11/2000 | Elliott | 343/895 |
| 6,219,902 | B1 * | 4/2001 | Memmen et al. | 29/600 |
| 6,271,804 | B1 | 8/2001 | Yanagisawa et al. | |

FOREIGN PATENT DOCUMENTS

| | | |
|---|---|---|
| GB | 2 305 298 A | 4/1997 |
| GB | 2 349 598 A | 11/2000 |

* cited by examiner

*Primary Examiner*—Minh Trinh
(74) *Attorney, Agent, or Firm*—Fulbright & Jaworski LLP

(57) ABSTRACT

Apparatus and method for producing a jacketed antenna, especially a mobile telephone antenna for motor vehicles, where the jacket is formed about antenna conductive parts in a mold. The mold having a centering pin for insertion in an antenna base body having a mating hole, and an antenna receiving portion attached to the base body so as to be aligned and centered in the mold by the centering pin to assure that the antenna conductive parts are completely encased in the jacketing material.

6 Claims, 2 Drawing Sheets

METHOD FOR PRODUCING A JACKETED MOBILE ANTENNA

BACKGROUND OF THE INVENTION

1. Field of the Invention

The present invention relates to an apparatus and method for manufacturing a jacketed antenna, and more particularly to an apparatus and method for manufacturing a mobile telephone antenna for motor vehicles that has electromagnetic wave receiving conductive parts centered in an encasing elastic nonconductive jacket.

2. Description of the Related Technology

Antennas, especially mobile telephone antennas for motor vehicles, are known. These antennas often include a base body from which a receiving portion extents, such as an antenna coil or an antenna rod. Further such base bodies are electrically conductive and can be made of metal with a contact area that is used to connect the antenna to a corresponding contact area on a motor vehicle by, for example, being screwed onto the motor vehicle body. Often the receiving portion of mobile antennas are elastic so that the mobile antennas are structurally compliant in the case of an accident and so that they can yield to wind forces. In addition to having elastic receiving portions, such mobile antennas often are surrounded with an electrically nonconductive jacket to protect encased metal parts from corrosion and to provide a smooth overall pleasant appearance for the mobile antenna structure.

It is known that such jacketed antenna structures can be manufactured by inserting an antenna base body with extending receiving portion into a mold and then filling the mold with the compound which forms the encasing jacket. A useful compound for the jacket can be a thermoplastic elastomer. It is important in this manufacturing process that the base body be centered when positioned in the mold because if one or more of the conductive antenna parts are not centered there is the possibility of not completely encasing them with the compound of the jacket. To address this problem, it has been suggested that the base body with the extending receiving portion be fixed in the mold with pins which extend in the direction of the lengthwise axis of the receiving portion. Such use of pins can position a base body with an extending receiving portion at a centered location in a mold. In doing so, however, there is an unavoidable problem in that holes are formed into the resulting jacket and moisture can penetrate through these holes into the interior of the antenna structure where metal corrosion can be produced that could lead to antenna malfunctions.

SUMMARY OF THE INVENTION

An object of the present invention is to provide an apparatus and method for manufacturing an antenna, especially a mobile telephone antenna, wherein electrically conductive metal antenna parts that would be exposed to environments exterior to mountings be completely encased by a jacket.

According to the invention, an antenna base body is provided with a hole of any shape, for example, with a drillhole that is aligned parallel with the lengthwise axis of the base body. Then at least the base body can be aligned to be centered in a mold by having a centering pin which can be inserted into the hole in the base body and thereby the base body can be positioned and fixed in the mold. This centering pin which is aligned on the lengthwise axis of the mold also ensures that the base body is located in the middle in the mold. The outside diameter of the centering pin and the inside diameter of the hole in the base body are made to be flush with one another. The receiving portion is aligned along the lengthwise axis of the base body and attached to it, and, therefore, the centering pin which is inserted into the hole in the base body ensures that both the base body and also the receiving portion are aligned along the center of the lengthwise axis of the mold so that these two antenna components, after they have been inserted into the mold on the centering pin, can be completely surrounded with a compound which forms an encasing jacket. Therefore, after the base body and the receiving portion are removed from the mold, they are encased by the jacket without openings into the antenna conductive parts. Jacketing the base body on its bottom in the contact area also can ensure that after inserting the antenna in a mounting moisture will not be allowed to penetrate into the contact area where electrical contact to the mounting is made. This arrangement is effected especially reliably when the contact area is made as a thread so that after tightening the screw connection the lower radial area of the jacket is easily squeezed and seals this area against penetration by moisture.

The antenna base body and the receiving portion can be two or more separate individual parts that are joined together in a mating manner. The base body also can be made in several parts. A single (integral) component for a base body and receiving portion that is a single unit having the function of both also would be within the scope of the present invention. Therefore, the entirety of the conductive parts of the antenna would be the base body with an attached receiving portion, i.e. a combination of a base body with an antenna coil, a spring, or the like.

One embodiment of the present invention has the receiving portion aligned to be centered in the mold by using the centering pin. For this embodiment of the invention the base body is aligned to be centered in the mold and the receiving portion is aligned to be flush to the base body to which it is attached. Precision production of the base body and the receiving portion, especially in their common attachment areas, can assure necessary alignment. Alternatively, this precision production can be eliminated if the receiving portion is aligned to be centered in the mold by the centering pin. This use of the centering pin can be readily accomplished if the receiving portion is made as an antenna coil (spring) with a hollow middle area. It is especially advantageous if the inside diameter of the hole in the base body and the inside diameter of the hollow middle area in the receiving portion almost agree and further closely correspond to the outside diameter of the centering pin in the mold to provide for a close fit. The closer the tolerances the better in assuring centered alignment of the base body and the receiving portion in the mold when supported by the centering pin.

BRIEF DESCRIPTION OF THE DRAWINGS

One embodiment of the invention for an apparatus and a method for manufacturing jacketed mobile antennas, which the invention however is not limited to and to which differences therefrom may occur to one skilled in the art without departing from the scope of the invention is described below and explained using the Figures, wherein.

DETAILED DESCRIPTION

Figure 1A:
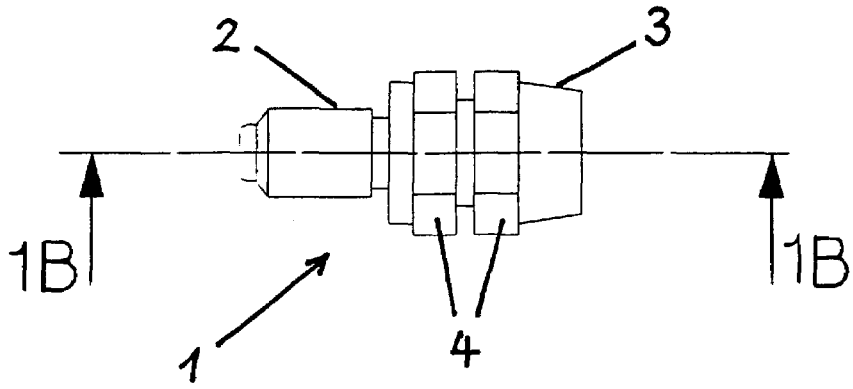
FIG. 1A is a side view of an antenna base body.

FIG. 1A shows a side view of a base body 1 for an antenna. The base body 1, which must conduct electricity, can be made of metal and can be made into final form by turning a semifinished base body part (not shown). Base body 1 has a contact area 2 which is made, for example, with exterior threads. Alternatively the exterior of contact area 2 can be formed to provide for a bayonet or other type connection structure. Using the embodiment shown in FIG. 1A a finished antenna would be screwed into a corresponding contact area on, for example, a motor vehicle. On the side facing away from the contact area 2 the base body 1 has a receiving area 3 which is configured to hold an electromagnetic wave receiving portion such as an antenna coil 7 (see FIG. 2A). Between the contact area 2 and the receiving area 3 there is an intermediate area 4 which is made for example to have an exterior polygon shape to provide a structure to prevent rotation between the base body 1 and jacket that will later be put around the base body 1.

Figure 1B:
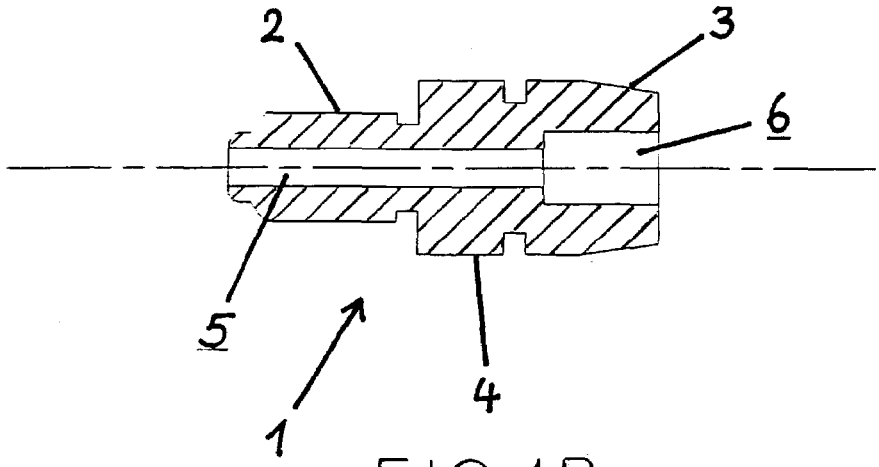
FIG. 1B is a sectional view of the antenna base body shown in FIG. 1A with a center hole according to one embodiment of the invention.

FIG. 1B shows a sectional view of base body 1 in a section 1B—1B according to FIG. 1A. As shown base body 1, at least in the contact area 2, but also essentially continuously through the length of the base body 1, has a hole 5. An additional hole 6 is shown in receiving area 3 of base body 1 for holding a receiving portion. This hole 6 is shown to be a blind hole and has a greater inside diameter than that of hole 5.

Figure 1C:
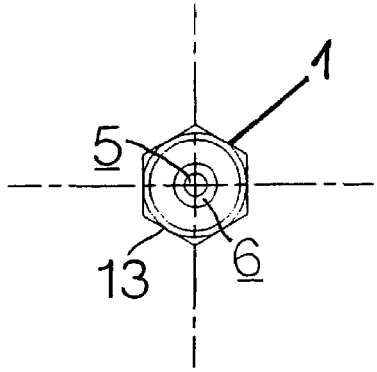
FIG. 1C is a top view of the antenna base body shown in FIG. 1A.

FIG. 1C shows a top view of base body 1 as viewed from the direction of the receiving area 3 with the hole 5, the hole 6 and a polygon 13 (especially a hexagon) exterior shape for the intermediate area 4.

Figure 2A:
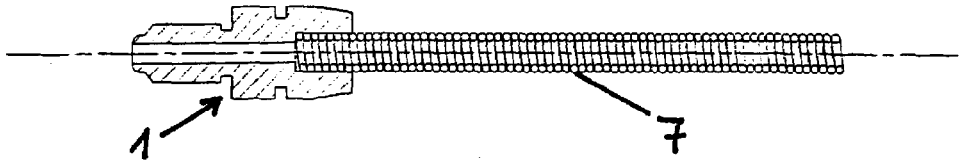
FIG. 2A is a sectional view of an antenna base body with an attached extending antenna coil.
Figure 2B:
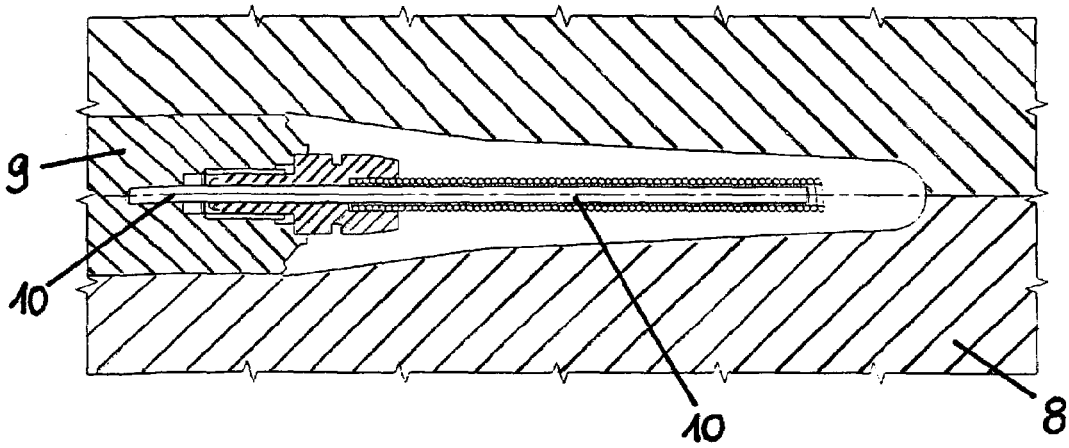
FIG. 2B is a sectional view of a mold with sealing piece having an attached extending centering pin according to one embodiment of the invention wherein an antenna base body and an attached antenna coil are shown supported on the centering pin; and, FIG. 2C is a sectional view of an antenna with an encasing jacket manufactured according to the present invention.
Figure 2C:
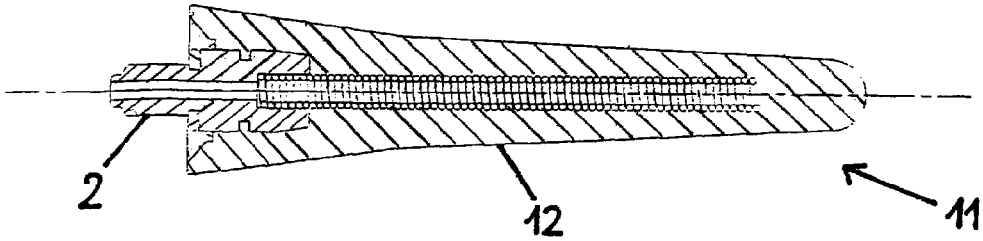

FIGS. 2A and 2B respectively show hardware for a process according to an embodiment of the invention for producing a complete finalized antenna 11 as shown in FIG. 2C. As shown in FIG. 1A, the base body 1 has been attached to a receiving portion, for example, an antenna coil 7 by having the antenna coil 7 fixed in the blind hole 6 of the base body 1. Such attachment of a receiving portion to a base body 1, for example, can be accomplished by a force fit or also by soldering, welding, cementing or other type of material connection.

FIG. 2B shows the base body 1 with the attached antenna coil 7, see FIG. 2A where base body 1 is positioned in mold 8. This positioning is done such that the base body 1 with at least contact area 2 being inserted into mold 8 so as to be adjacent a sealing piece 9 and as shown contact area 2 is encased in sealing piece 9. This sealing piece 9 has a centering pin 10 securely connected to it, the sealing piece 9 is inserted and fixed with its centering pin 10 in the mold 8 such that the centering pin 10 is aligned in the middle and along the lengthwise axis of the mold 8. Having an exact alignment of centering pin 10 in the mold 8 ensures that the base body 1 and attached receiving portion also are fixed exactly in the middle and centered in the mold 8. For the embodiment of the invention shown in FIG. 2B the centering pin 10 extends both through the hole 5 in the base body 1 and also at least in part, but essentially over the entire length of the antenna coil 7. This structure ensures improved centering in mold 8 of the antenna coil 7 in addition to such centering of base body 1 in the lengthwise direction. After a base body 1 and an attached receiving portion are so positioned in mold 8, the free area of the mold 8 is filled with a compound, for example, an elastic compound that can be especially squirted. Such an elastic compound can be, for example, a thermoplastic elastomer (TPE). After this compound sets, a finished antenna 11 can be removed from the mold 8, either by the sealing piece 9 being pulled out of the mold 8, or the antenna being removed from the sealing piece 9, so that the finished antenna 11 is accessible. In both cases, the mold 8 consisting of two identical halves (both halves being shown in FIG. 2B) which are separated from one another.

FIG. 2C shows the finished antenna 11 with the base body 1 (except for its contact area 2) including the attached antenna coil 7 being surrounded completely by jacket 12 formed from the compound filled into mold 8 without parts of the base body 1 or of the antenna coil 7 penetrating outside the jacket 12 (except for the contact area 2). The antenna coil 7 is aligned to the lengthwise axis of the finished antenna 11 in relation to the jacket 12. After attaching the finished antenna 11 to a motor vehicle (not shown) there are no metallic areas that are exposed outside of jacket 12.

What is claimed is:

1. A method for molding a jacket about an antenna electrically conductive base body including a contact area, said method comprising:

disposing said base body on a centering pin disposed to be centered in a mold, said centering pin having an outside diameter that fits in a hole disposed along a lengthwise axis of said base body so that when said base body is disposed on said centering pin said base body is maintained in a position centered in said mold to permit a jacket to be formed in said mold about a portion of said base body not including said contact area;

filling said mold with an elastic compound to form said jacket about said base body but not to form said jacket about said contact area of said base body; and, releasing said mold and removing said base body with the encasing formed jacket.

2. The method for molding a jacket about an antenna according to claim 1, wherein said base body has an attached electrically conductive receiving portion so that when said base body is disposed on said centering pin said base body with attached receiving portion is maintained in a position centered in said mold to permit the jacket to be formed in said mold about said base body with attached receiving portion.

3. The method for molding a jacket about an antenna according to claim 2, wherein said receiving portion comprises an antenna coil.

4. The method for molding a jacket about an antenna according to claim 3, further comprising disposing both said base body and said antenna coil on said centering pin so that said base body with attached antenna coil are maintained in a position centered in said mold to permit the jacket to be formed in said mold about said base body with attached antenna coil.

5. The method for molding a jacket about an antenna according to claim 1, wherein a sealing piece is disposed into said mold and said centering pin is disposed from said sealing piece so that said contact area of said base body when disposed on said centering pin is positioned within said sealing piece to prevent the elastic compound from forming a jacket about said contact area.

6. The method for molding a jacket about an antenna according to claim 1, wherein said elastic compound is a thermoplastic elastomer.

* * * * *